United States Patent [19]

May et al.

[11] Patent Number: 4,698,043

[45] Date of Patent: Oct. 6, 1987

[54] ROLLING EGG TOY

[75] Inventors: Richard L. May; Jonathan R. May, both of Manhattan Beach, Calif.

[73] Assignee: May-Curran Associates, Redondo Beach, Calif.

[21] Appl. No.: 861,358

[22] Filed: May 9, 1986

[51] Int. Cl.[4] ..... A63H 15/06

[52] U.S. Cl. ..... 446/273; 446/279

[58] Field of Search ..... 446/273, 268, 279, 310, 446/385

[56] References Cited

U.S. PATENT DOCUMENTS 968,057 8/1910 Iwata ..... 446/310 X 1,585,887 5/1926 Beach ..... 446/310

1,643,916 9/1927 Becker ..... 446/273

FOREIGN PATENT DOCUMENTS 923055 2/1955 Fed. Rep. of Germany ..... 446/310

417206 2/1947 Italy ..... 446/273

*Primary Examiner*—Kenneth J. Dorner

*Assistant Examiner*—Peter R. Brown

*Attorney, Agent, or Firm*—Keith D. Beecher

[57] ABSTRACT

A toy in the form of an egg. When rolled along the floor, the egg opens and a monster or other figure within the egg springs up is held in an upright position as the egg continues to roll along the floor.

4 Claims, 8 Drawing Figures

FIG. 8
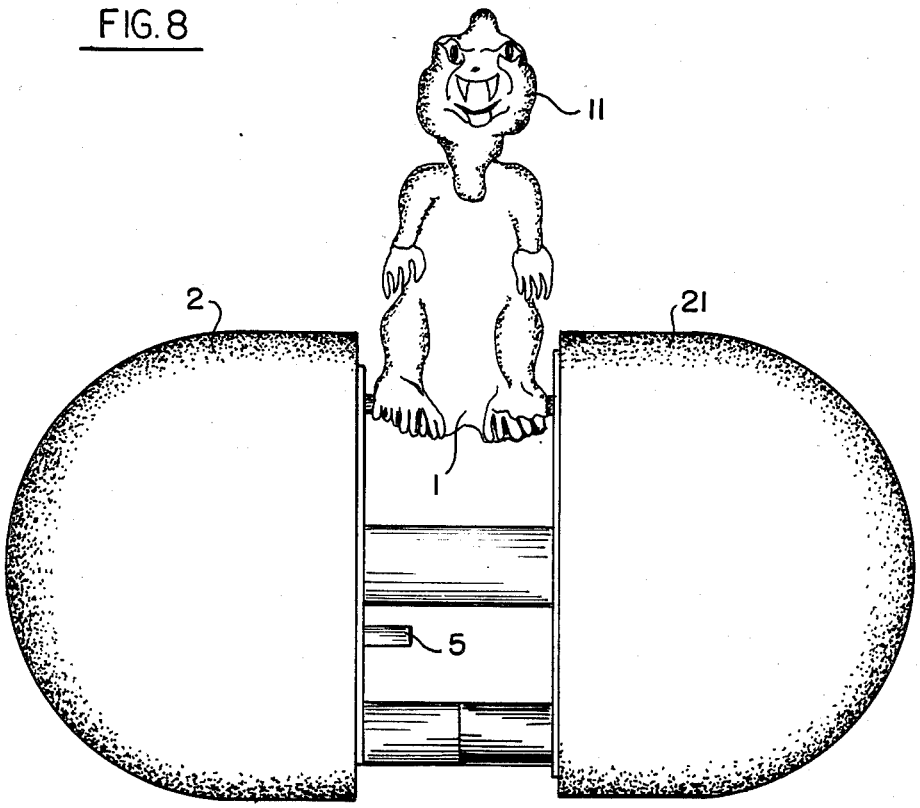
FIG. 6
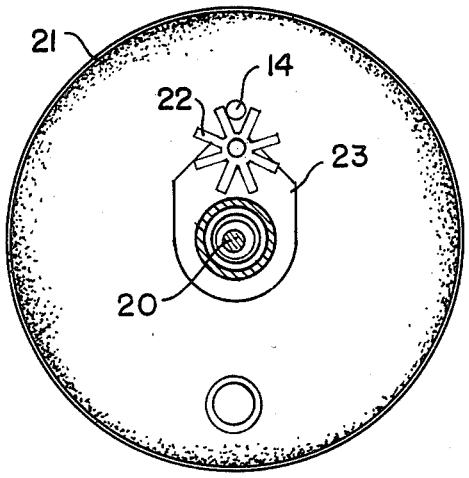
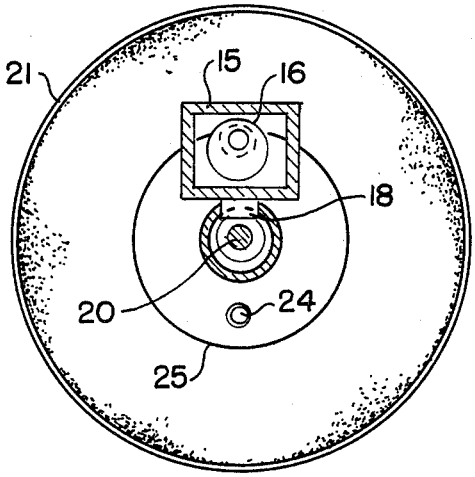
FIG. 7

ROLLING EGG TOY

BACKGROUND OF THE INVENTION

The invention is concerned with mechanical toys, and more particularly with that class of toys in which a traveling carriage in its movement carries and actuates a spring, so that the carriage may open and a figure contained within the carriage will pop out of the carriage and be held in a substantially uprihgt position.

In the particular toy of the present invention, the carriage is in the form of an egg, which opens when it is rolled along the floor, and the internal figure is in the form of a monster, which springs out of the egg and is held in an upright position as the egg continues its motion.

SUMMARY OF THE INVENTION

The invention provides a toy having an enclosure formed of two rollable sections which are movable axially with respect to one another between an open position and a closed position. A figure is contained within the enclosure, and a mechanism is coupled to the two sections of the enclosure and to the figure to cause the sections to separate and the figure to pop out of the enclosure when the enclosure is rolled along a surface. The mechanism also includes a latch coupled to the enclosure sections which hold the sections in a closed position, and a mechanism coupled to the latch to cause the latch to open after a predetermined number of rotations of the enclosure, together with a spring connected to the sections to draw the sections apart to the open position when the latch is released.

BRIEF DESCRIPTION OF THE DRAWINGS

FIGS. 4, 5, 6, and 7 are cross-sectional views taken along the lines 4—4, 5—5, 6—6, and 7—7 respectively of FIG. 3; and FIG. 8 is an elevational view, like FIG. 2, of the toy egg in its open position.

DETAILED DESCRIPTION OF THE ILLUSTRATED EMBODIMENT

Figure 2:
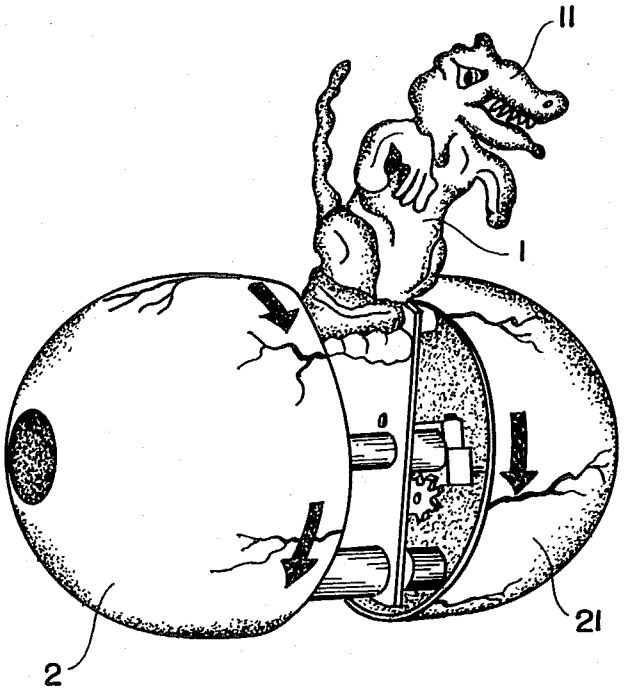
FIG. 2 shows the toy egg in its open position with the monster being held in its vertical popped-up positicn.

The toy egg of the invention is operated by turning a monster 1 (FIG. 2) into two sections 2 and 21 of the egg. Section 2 is the moving section of the egg and section 21 is the stationary section. The monster's head is designated 11.

Specifically, to operate the toy, the monster's head 11 (FIG. 2) is gently pushed down against its chest, and the monster is then turned down until a latch (to be described) catches its front foot. This causes the monster's tail automatically to fold in towards its body.

Figure 1:
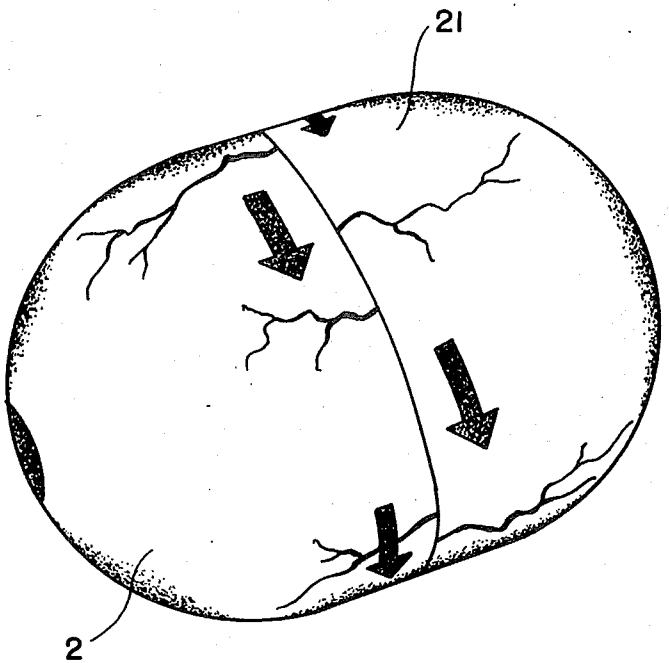
FIG. 1 shows the toy egg in its closed position.
Figure 4:
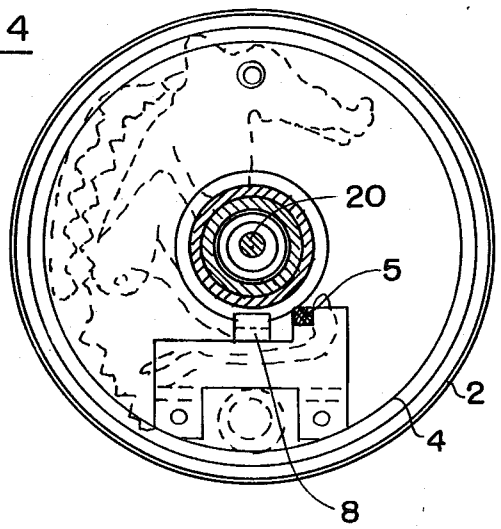
Figure 5:
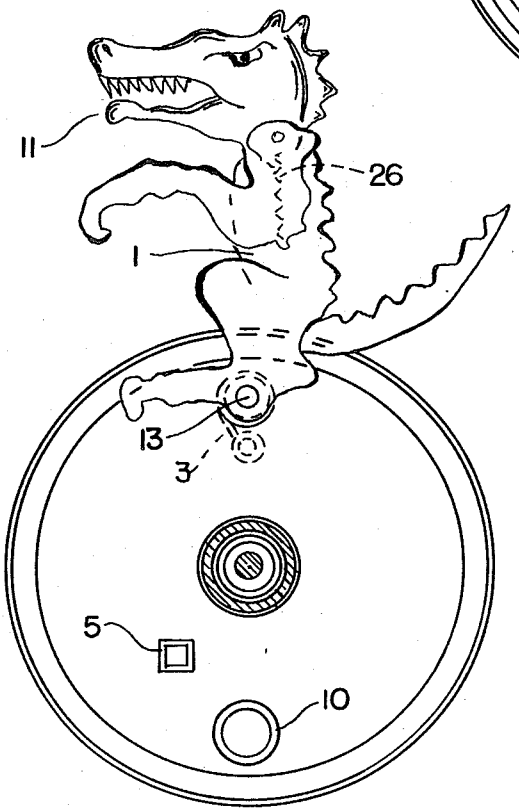
Figure 3:
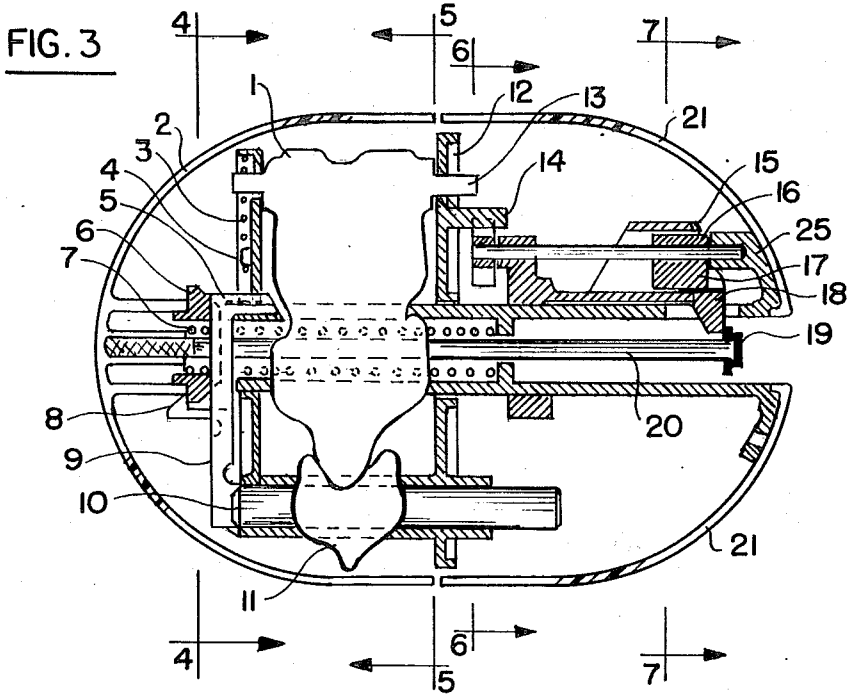
FIG. 3 is a longetudinal sectional view of the toy egg.

The two sections 2, 21 of the egg (FIG. 2) are then pushed together until they meet and latch. This provides the configuration of FIG. 1.

Then, if the toy egg is grasped by both hands and rolled along the floor, the two sections 2, 21 of the egg will separate, and the monster will pop up automatically to assume the upright position of FIG. 2. The egg then continue to roll with the monster remaining in its upright position.

With reference now to FIGS. 3–7, a spring 3 is provided which causes the monster to pop up when the egg is opened. The monster 1, is pivotally mounted between a frame 4 in the moving section 2 of the egg and a frame 12 in the stationary section 21 of the egg. The monster is pivoted at one end of the frame along a pivot axis 13. A counter-balance 10 is also mounted on the frame 4, 12 at the other end of the frame.

A pin 5 is provided to hold the monster in its folded condition. Also, a hook 6 is attached to the moving section 2 of the egg which mates with a latch 8 to hold the two sections 2, 21 in their closed position of FIG. 1. A spring 7 is included which causes the two sections 2, 21 to separate when the latch 8 is released. A lock 9 for the egg is also provided. The monster's head 11, is resiliently coupled to its body.

A timer pin gear is designated 14, and a cam contact is designated 15. A cam timer 16 includes a lobe 17 which causes a latch 18 to release the sections 2, 21, so that spring 7 may cause the sections to separate. A press-on nut 19 the keep the two sections 2, 21 together, and the nut also serves as a sear.

The egg includes an axle 20. A timer gear 22 is provided, as is a timer latch and base 23. A locater pin is designated 24. An axle tube for the stationary section 21 is designated 25, and a spring 26 resiliently couples the monster's head 11 to its body.

As mentioned above, the toy is operated by folding the monster 1 into the interior of the enclosure and latching the monster in its folded position. The two sections 2 and 21 of the egg are then pushed together. Then, and as also explained above, when the closed egg (FIG. 1) is rolled along the floor, it will roll about 7–9 revolutions and then burst open to the condition shown in FIG. 2. This releases the monster 1 into a vertical position, as shown in FIG. 2, and the egg will continue to roll.

The entire assembly basically comprises three parts, (A) the egg sections 2 and 21; (B) the monster assembly 1 and 11; and (C) the operating mechanism.

The enclosure assembly, as described above, is composed of two half section in the form of hemispheres 2 and 21, the two hemispheres being held together by a shaft 20 which is attached to one of the hemispheres 2, and which slides in a tube 25 attached to the other hemisphere 21. Spring 7 is located on shaft 20 which fits into tube 25, and the spring urges the two hemispheres apart. The assembly is held together by press-on nut 19, or its equivalent. The nut has a flat side with a sharp edge so that it can serve as half a sear latch set.

Also located on tube 25 and freely rotatable on the tube is the mechanism 4, 12 which holds the monster 1; counter-balance 10; and a portion of timing mechanism 9, 14. The timing mechanism is located on tube 25 so that when the two hemispheres separate, the monster and mechanism are positioned in the space between the two halves.

The bottom half of the mechanism contains the counter-balance 10 which is of a mass sufficient to overcome the sliding friction on tube 25 and the mass of the monster and mechanism.

The monster 1 is pivotally located on the top of the mechanism. The monster is spring loaded by spring 3 so that it stands upright with respect to the surface upon which the toy egg is rolled as shown in FIG. 8.

The mechanism is constructed so that sear latch 18 holds the two sections, 2, 21 in the closed position of FIG. The sear latch 18 holds the two sections closed against the tension of spring 7. The latch 18 is released by gear 22 located on tube 25 when the gear reaches a pre-determined angular position. The gear 18 is turned a partial turn towards the predetermined angular position each time the egg rotates. Pin 13 on the mechanism contacts gear 22 and turns the gear and a cam 16 attached to gear 22. When the gear reaches the predetermined angular position, the cam released the latch. In a constructed embodiment, an eight-tooth gear 22 is used which causes the sear latch 18 to open after eight turns of the egg.

A latch 5 and two sections lock 9 hold the monster in a folded position so that the 2, 21 may close. When the sections close, hook 6 on the moving section latches with latch 9, and also holds the monster in a folded position.

When the mechanism triggers and allows the sections 1, 11 to open, latch 5 on the mechanism is opened causing the monster 1 to spring into its upright position of FIGS. 2 and 8.

The monster may be designed to be animated by making the body foldable against springs such as spring 3 and 26. By keeping the springs light, the body 1 will bounce and appear lifelike. Folding the body and/or head 11 of monster 1 will make the monster appear larger as it emerges from the enclosure.

It is obvious that the sections 2, 21 may have any closed or semi-closed configuration; and they may be hemispherical, cylindrical, egg-shaped, tire-shaped, tubular, or any round rollable shape.

It is also evident that while a particular embodiment of the invention has been shown and described, modifications may be made. It is intended in the claims to cover all modification which come within the true spirit and scope of the invention.

We claim:

1. A toy having an enclosure formed of two rollable sections movable axially with respect to one another between an open position and a closed position; a figure contained within the enclosure; and a mechanism coupled to the two sections of the enclosure and to the figure to cause the sections to separate and the figure to pop out of the enclosure when the enclosure is rolled along the surface; said mechanism including a latch coupled to the enclosure sections to hold the sections in a closed position, means coupled to the latch to cause the latch to open after a predetermined number of rotations of the enclosure, and a spring connected to the sections to draw the sections apart to the open position when the latch is released.

2. The toy defined in claim 1, in which each of the sections has a hemispherical shape and the toy has an egg-like configuration.

3. The egg-like toy defined in claim 1, in which the mechanism further includes a frame, and means coupling the figure to the frame for pivotal movement of the figure about a pivotal axis; and a spring connected to the figure and to the frame for causing the figure to pop up when the sections are moved to their open position.

4. The toy defined in claim 3, in which the mechanism further includes means retaining the figure in an uprihgt position when the enclosure sections are in their open position, with the two sections rotating about the pivot axis of the figure.

* * * * *